United States Patent [19]

Fujiwara

[11] Patent Number: 4,667,387

[45] Date of Patent: May 26, 1987

[54] METHOD FOR MANUFACTURING VALVE COVERS OF COMPRESSOR

[75] Inventor: Takayoshi Fujiwara, Hino, Japan

[73] Assignee: Kabushiki Kaisha Toshiba, Kawasaki, Japan

[21] Appl. No.: 801,308

[22] Filed: Nov. 25, 1985

[30] Foreign Application Priority Data

Nov. 29, 1984 [JP] Japan ..... 59-252324

[51] Int. Cl.[4] ..... B21D 53/00; B21K 21/00

[52] U.S. Cl. ..... 29/157 R; 29/445; 228/155; 228/173.6; 228/184

[58] Field of Search ..... 29/156.4 R, 156.7 R, 29/445, 463, 157 A, 157.3 D, 158, 157 R; 72/381, 389, 469; 181/240, 403; 417/312, 902; 228/155, 173.6, 184

[56] References Cited

U.S. PATENT DOCUMENTS

| | | | |
|---|---|---|---|
| 1,225,788 | 5/1917 | Dies | 29/157 A |
| 1,992,835 | 2/1935 | Newman | 29/157 A |
| 2,377,557 | 6/1945 | Johnson | 29/157.3 D |
| 2,944,583 | 7/1960 | Welindt | 72/469 |

FOREIGN PATENT DOCUMENTS

| | | | |
|---|---|---|---|
| 82842 | 1/1957 | Denmark | 181/403 |
| 3150426 | 7/1983 | Fed. Rep. of Germany | 72/369 |
| 104376 | 6/1983 | Japan | 417/312 |
| 58-167780 | 11/1983 | Japan . | |
| 176478 | 10/1984 | Japan | 417/312 |

*Primary Examiner*—Lowell A. Larson

*Attorney, Agent, or Firm*—Cushman, Darby & Cushman

[57] ABSTRACT

A value cover of a compressor is manufactured by the following steps. First, a first metal plate, which has depressed portions for defining a muffling chamber and a connecting passage, is prepared. A second metal plate, which has depressed portions for defining a discharge chamber and the muffling chamber, is prepared. Then, the metal plates are joined together to form an integral structure having the discharge chamber, the muffling chamber, and the connecting passage defined by the depressed portions. Thereafter, the integral structure is bent at the portion for the connecting passage so that a predetermined angle is formed between the discharge chamber and the first metal plate forms the inner part of the bent portion and the muffling chamber.

7 Claims, 9 Drawing Figures

METHOD FOR MANUFACTURING VALVE COVERS OF COMPRESSOR

BACKGROUND OF THE INVENTION

The present invention relates to method for manufacturing a valve cover of a compressor adapted to be fitted on a compressor cylinder.

In general, compressors used in the refrigeration cycle of air conditioning systems or the like comprise a cylinder containing a piston, and a valve cover attached to an open end of the cylinder. The valve cover includes a discharge chamber for receiving a compressed refrigerant discharged from the cylinder, a muffling chamber for arresting noise produced by the compressed refrigerant, and a connecting passage connecting the discharge chamber and the muffling chamber. Conventionally, the valve cover is formed by joining, by copper-alloy brazing or the like, the peripheral edges of two metal plates that are each preformed with depressed portions by pressing or other method so that the combined depressed portions define the chambers and the passage.

In the valve cover fabricated in this manner, the chambers and the passage are arranged substantially in a straight line. When the valve cover is attached to the open end of the cylinder, therefore, part of the valve cover, especially the muffling chamber, would substantially project outward from the cylinder. Thus, the mounting of the valve cover requires a wide space, leading to an increase in the overall size of the compressor.

Hereupon, a conventional method for manufacturing a valve cover is proposed in which a valve cover member having a discharge chamber and another valve cover member having a muffling chamber are separately formed and coupled substantially at right angles to each other. Use of the valve cover made by this method may prevent the muffling chamber from projecting from the cylinder, thereby permitting a compact compressor design. The valve cover of this type, however, requires brazing at a number of spots for bonding as well as a good many components, resulting in increased manufacturing cost and complicated manufacturing processes.

SUMMARY OF THE INVENTION

The present invention is contrived in consideration of these circumstances, and is intended to provide a method for manufacturing valve covers, whereby low-priced valve covers can be manufactured efficiently.

In order to achieve the above object, a method for manufacturing valve covers according to the present invention comprises steps of preparing first and second metal plates, forming depressed portions for individually defining a muffling chamber and a connecting passage in the first metal plate, forming depressed portions for individually defining a discharge chamber and the muffling chamber in the second metal plate, joining the first and second metal plates to form an integral structure having the discharge chamber, the muffling chamber, and the connecting passage defined by the depressed portions, and bending the integral structure at the portion for the connecting passage in a direction such that the discharge chamber and the muffling chamber approach each other to form a predetermined angle therebetween and the first metal plate forms the inner part of the bent portion.

BRIEF DESCRIPTION OF THE DRAWINGS

FIGS. 2 to 9 illustrate a manufacturing method according to an embodiment of the present invention, in which FIGS. 2, 3 and 4 are a side view, a bottom view, and a vertical sectional view, respectively, of an integral formed structure, FIG. 5 is a sectional view taken along line V—V of FIG. 2, FIG. 6 is a sectional view for illustrating a bending step, FIG. 7 is a sectional view taken along line VII—VII of FIG. 6, FIG. 8 is a sectional view showing a bending jig abutting against the integral formed structure, and FIG. 9 is a sectional view of the integral formed structure at the end of the bending step.

DETAILED DESCRIPTION OF THE PREFERRED EMBODIMENTS

An embodiment of the present invention will now be described in detail with reference to the accompanying drawings.

Figure 1:
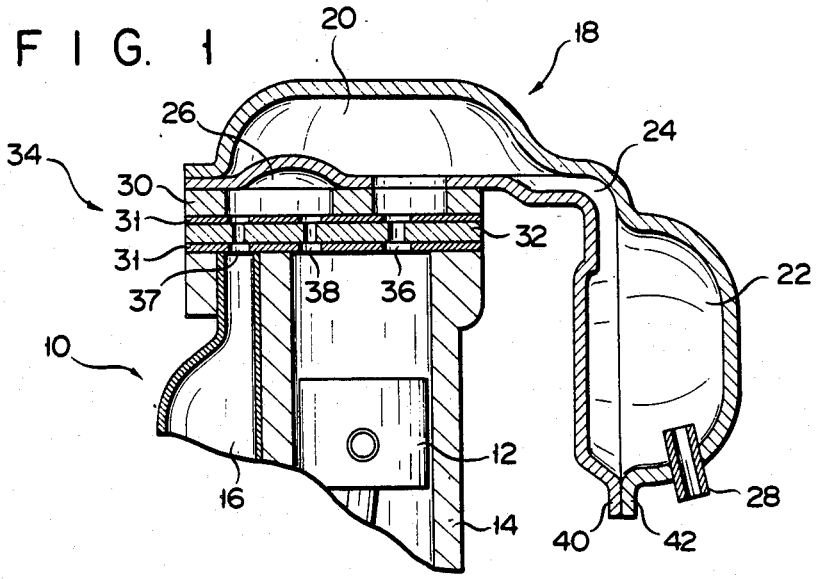
FIG. 1 is a sectional view of a compressor with a valve cover manufactured by a method according to the present invention.
Figure 2:
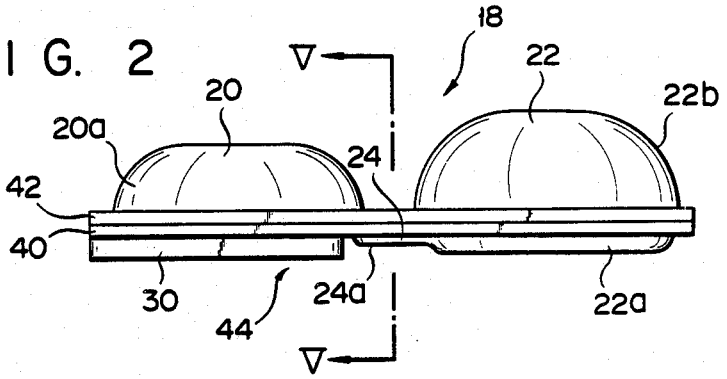
Figure 3:
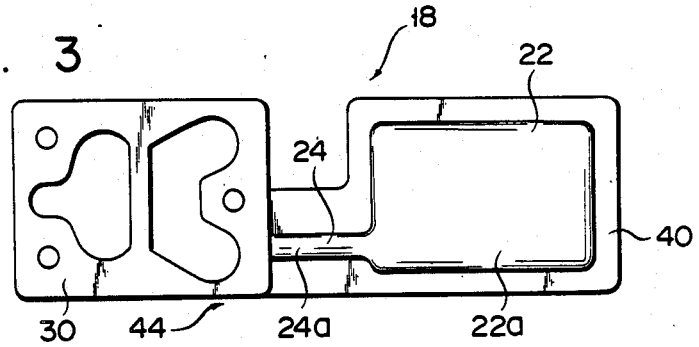
Figure 4:
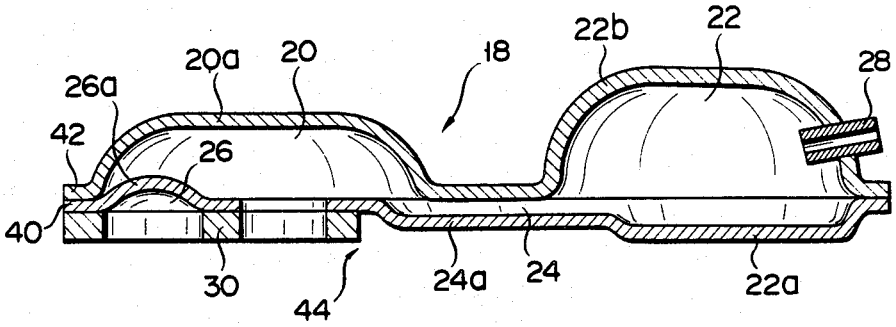

FIG. 1 shows a reciprocating compressor fitted with a valve cover which is manufactured by a method according to the present invention.

The compressor 10 comprises a cylinder 14 containing a piston 12, and a muffler 16 fixed to the cylinder 14. A valve cover 18 includes a discharge chamber 20, a muffling chamber 22, a connecting passage 24 connecting the discharge chamber and the muffling chamber, and a suction chamber 26. A discharge pipe 28 is inserted in the muffling chamber 22. The valve cover 18 is substantially L-shaped, bent at the portion corresponding to the connecting passage 24. The discharge chamber 20 and the suction chamber 26 are located over an open end of the cylinder 14, and the muffling chamber 22 faces the peripheral wall of the cylinder 14. The valve cover 18 is fixed to the upper end edge of the cylinder 14 by means of a laminated structure 34 which includes a valve base 30, a pair of packings 31, and a valve plate 32. The discharge chamber 20 communicates with the inside of the cylinder 14 through a discharge port 36 bored through the laminated structure 34, while the suction chamber 26 communicates with the muffler 16 and the cylinder 14 by means of first and second suction ports 37 and 38, respectively, in the laminated structure.

When the piston 12 is actuated, a refrigerant is sucked into the cylinder 14 through the muffler 16, first suction port 37, suction chamber 26, and second suction port 38. After it is compressed in the cylinder 14, the refrigerant flows through the discharge port 36 into the discharge chamber 20. Further, the refrigerant flows through the connecting passage 24 into the muffler chamber 22, where it is muffled and delivered to a desired region through the discharge pipe 28.

A method for manufacturing the valve cover with the above-mentioned construction will now be described.

As shown in FIGS. 2 to 5, the valve cover 18 is fabricated by joining together a plurality of metal plates, e.g., first and second metal plates 40 and 42. In the first metal plate 40 are formed a depressed portion 22*a* for defining part of the muffling chamber 22, a depressed portion 24*a* for defining the connecting passage 24, and a projection 26*a* for defining the suction chamber 26. In the second metal plate 42 are formed a depressed portion 20*a* for defining the discharge chamber 20 and a depressed portion 22*b* for defining part of the muffling chamber 22. These depressed portions are formed by pressing or drawing. The first and second metal plates 40 and 42 are put together, and their contact surfaces are coupled to each other by brazing or the like. Thus, an integral structure 44 is formed which includes the discharge chamber 20, connecting passage 24, muffling chamber 22, and suction chamber 26 defined by the depressed portions 20*a*, 24*a*, 22*a* and 22*b* and the projection 26*a*. The discharge chamber 20, connecting passage 24, muffling chamber 22, and suction chamber 26 are arranged substantially in a straight line. After the integral structure 44 is formed, the valve base 30 is brazed to the first metal plate 40 so as to face the discharge chamber 20 and the suction chamber 26.

Figure 5:
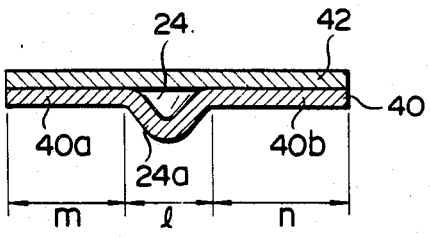

The depressed portion 24*a* for defining the connecting passage 24 is formed by drawing. As shown in FIG. 5, the first metal plate 40 has flat portions 40*a* and 40*b* on either side of the depression 24*a*. The width m or n of at least one of the flat portions 40*a* and 40*b* is greater than the width 1 of the depressed portion 24*a*.

The discharge pipe 28 is fixed to the integral structure 44 with the aforementioned construction so as to communicate with the muffling chamber 22.

Figure 6:
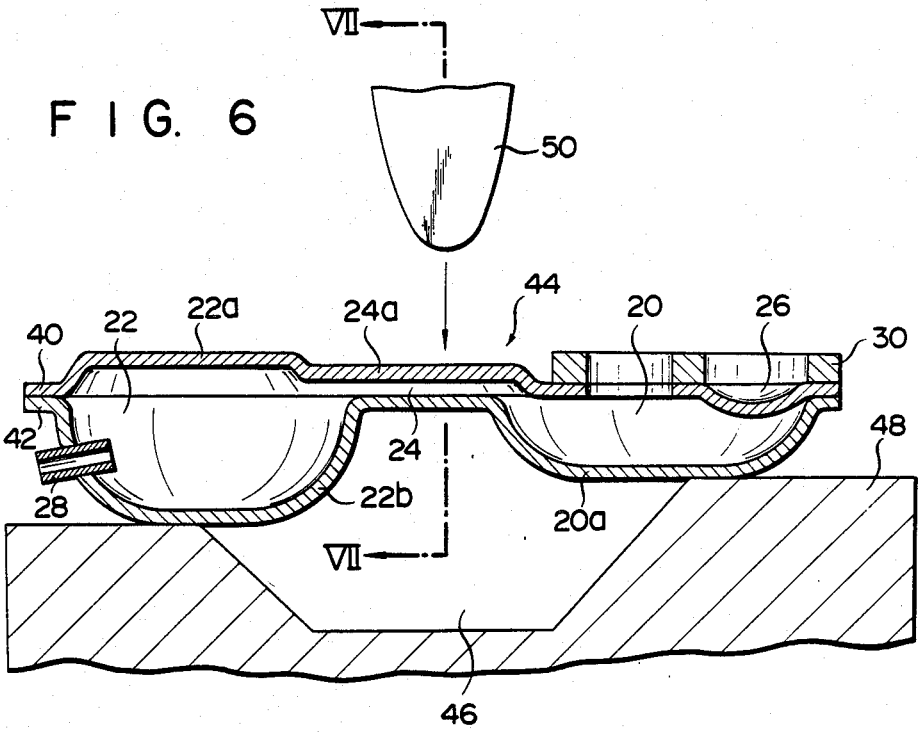

The integral structure 44 is bent to a predetermined angle at the connecting passage 24 in the following manner. First, a receiving jig 48 having a bending recess 46 is prepared, and the integral structure 44 is set on the jig 48, as shown in FIG. 6. In doing this, the integral structure 44 is laid across the recess 46 so that the connecting passage 24 is located over the recess 46. Also, the integral structure 44 is placed so that the first metal plate 40 with the depressed portion 24*a* is located above the second metal plate 42.

Figure 7:
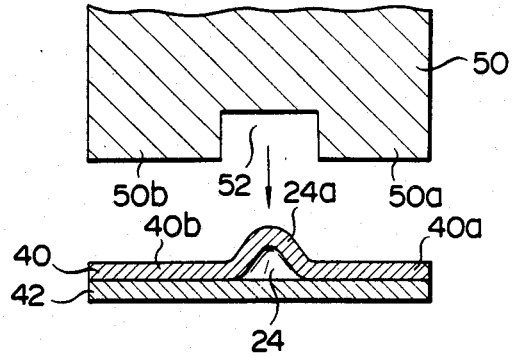
Figure 8:
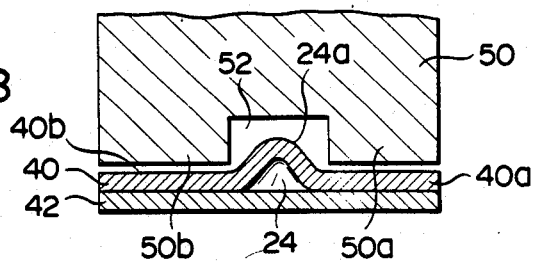
Figure 9:
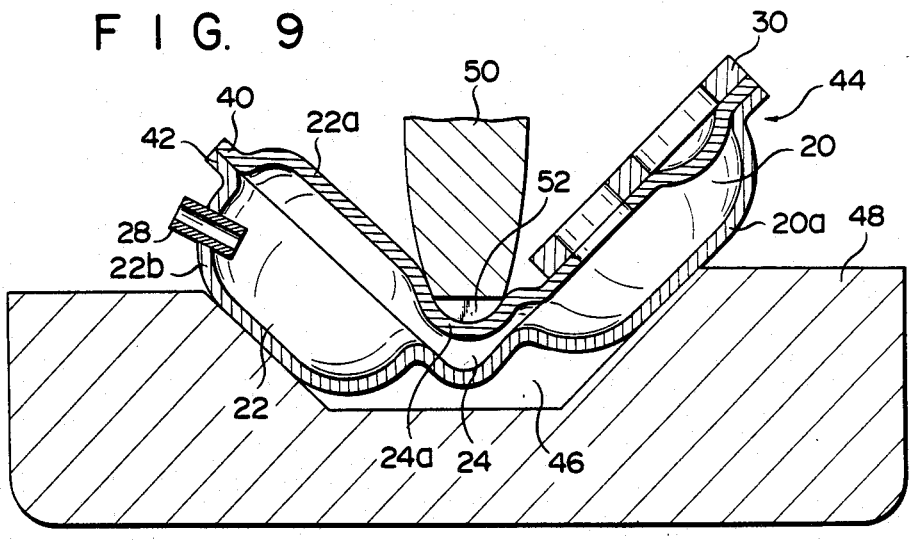

In this state, a tapered bending jig 50 is pushed down from above the integral formed structure 44 toward the connecting passage 24 thereof. As shown in FIG. 7, the distal end portion of the bending jig 50 is formed with an escape groove 52 having a width and depth greater than the width and height, respectively, of the depressed portion 24*a* for the connecting passage 24, and pressing portions 50*a* and 50*b* disposed on either side of the escape groove 52 and adapted to abut against the flat portions 40*a* and 40*b*, respectively, of the first metal plate 40. When the bending jig 50 is pushed down, the pressing portions 50*a* and 50*b* abut against their corresponding flat portions 40*a* and 40*b* of the first metal plate 40, and the depressed portion 24*a* is received by the escape groove 52, as shown in FIG. 8. As the bending jig 50, in this state, is further lowered, the depressed portion 24*a* and the flat portions 40*a* and 40*b* of the integral structure 44 are gradually bent and pressed into the recess 46 of the receiving jig 48 by the bending jig 50. This bending work is continued until an angle of approximately 90 degrees is formed between the discharge chamber 20 and the muffling chamber 22. In doing this, the depressed portion 24*a* for the connecting passage 24 is located so as to form the inner part of the bent portion.

The valve cover 18 manufactured by the aforesaid processes is fixed to the cylinder 14 of the compressor, as shown in FIG. 1.

According to the manufacturing method described above, an integral structure integrally having a discharge chamber, a connecting passage, and a muffling chamber is bent after it is formed by joining a pair of metal plates together. Thus, the components of the valve cover made by this method is fewer than those required by the prior art valve cover which is manufactured by coupling a valve cover member having a discharge chamber and another valve cover member having a muffling chamber after separately forming these members. Moreover, the metal plates can be coupled by uniform, plane brazing at fewer spots. It is therefore possible to securely prevent a gas leakage after the brazing. Thus, a low-cost valve cover can be manufactured with high reliability which is bent at a predetermined angle, permitting miniaturization of the compressor.

The integral structure is bent so that the depressed portion 24*a* for the connecting passage 24 forms the inner part of the bent portion. Accordingly, the connecting passage 24 can be prevented from being crushed or closed, or from being reduced in cross-sectional area. Thus, the resulting valve cover can keep the cross-sectional area of its connecting passage uniform throughout the passage, allowing the refrigerant to flow smoothly through the connecting passage.

Alternatively, the depressed portion for the connecting passage may be formed in the second metal plate 42 so that the integral structure is bent in a manner such that the depressed portion for the connecting passage forms the outer part of the bent portion. In this case, however, the inner first metal plate may possibly project into the connecting passage at the bending portion of the integral structure, thereby crushing the connecting passage. As a result, the connecting passage may be closed or reduced in cross-section area, so that the flow of the refrigerant passing through the connecting passage will become unstable. These problems can be solved by the arrangement of this embodiment.

In bending the integral structure by means of the bending jig, furthermore, the depressed portion 24*a* for the connecting passage is received in the escape groove of the bending jig so that only the flat portions 40*a* and 40*b* abut against the depressing portions 50*a* and 50*b*, respectively, of the bending jig. During the bending work, therefore, the depression 24*a* is kept from being pressed directly by the bending jig, so that the connecting passage can more securely be prevented from being crushed. The width of at least one of the flat portions is greater than that of the depressed portion 24*a*, and the bending jig is allowed to abut against the flat portions only. Thus, the valve cover can be prevented from being distorted after the bending work, unlike the valve cover formed by pressing the depressed portion for the connecting passage directly by means of the bending jig. If only the flat portions are pressed for bending, moreover, the radius of curvature of the bent portion can be made greater than in the case where the structure is bent by directly pressing the depressed portion for the connecting passage. Thus, the valve cover can be prevented from being cracked after the bending work.

It is to be understood that the present invention is not limited to the embodiment described above, and that various changes and modifications may be effected therein by one skilled in the art without departing from the scope or spirit of the invention. In the above embodiment, for example, the muffling chamber is located on the right, as in FIG. 1, of the discharge chamber. Alternatively, however, the former may be disposed on the left of the latter.

What is claimed is:

1. A method for manufacturing a valve cover of a compressor having a discharge chamber, a muffling chamber, and a connecting passage connecting the two chambers, comprising the steps of:

preparing first and second metal plates;

forming, in the first metal plate, depressed portions for individually defining portions of the muffling chamber and the connecting passage;

forming, in the second metal plate, depressed portions for individually defining portions of the discharge chamber and the muffling chamber;

joining the first and second metal plates to form an integral structure having the discharge chamber, the muffling chamber, and the connecting passage defined by the depressed portions; and bending the integral structure at the portion for the connecting passage so that a predetermined angle is formed between the discharge chamber and the muffling chamber and the first metal plate forms the inner part of the bent portion.

2. The method according to claim 1, wherein said first metal plate is worked so that flat portions are formed on either side of the depressed portion for the connecting passage, arranged across the same, the width of at least one of said flat portions being greater than that of the depressed portion for the connecting passage.

3. The method according to claim 2, wherein said integral structure is bent by pressing the flat portions.

4. The method according to claim 2, wherein said bending step includes a process of preparing a receiving jig having a bending recess, a process of placing the integral structure on the receiving jig so that the connecting passage is located over the bending recess and that the second metal plate is situated on the receiving jig side, and a process of pressing a bending jig against the connecting passage portion of the integral structure from the first metal plate side, thereby pressing the connecting passage portion into the bending recess of the receiving jig.

5. The method according to claim 4, wherein said bending jig is tapered and provided at its distal end with an escape groove having a width and depth greater than those of the depressed portion for the connecting passage and adapted to receive the connecting passage depressed portion, and pressing portions located on either side of the escape groove and adapted to abut against the flat portions.

6. The method according to claim 2, wherein said integral structure is bent along a line extending at right angles to the connecting passage on the flat portions.

7. The method according to claim 1, wherein said integral structure is bent so that an angle of approximately 90 degrees is formed between the discharge chamber and the muffling chamber.

* * * * *